United States Patent [19]

Chmielewski

[11] Patent Number: 4,577,599

[45] Date of Patent: Mar. 25, 1986

[54] REMOTE STARTER FOR INTERNAL COMBUSTION ENGINE

[75] Inventor: Cary J. Chmielewski, N. Fond du Lac, Wis.

[73] Assignee: Brunswick Corporation, Skokie, Ill.

[21] Appl. No.: 423,816

[22] Filed: Sep. 27, 1982

[51] Int. Cl.[4] ..... F02N 11/08

[52] U.S. Cl. ..... 123/179 B; 123/179 G; 290/38 C

[58] Field of Search ..... 123/179 B, 179 BG, 179 G; 290/38 C, DIG. 3, 38 E

[56] References Cited

U.S. PATENT DOCUMENTS

| | | | |
|---|---|---|---|
| 2,887,588 | 5/1959 | Williams | 123/179 B |
| 3,455,403 | 7/1969 | Hawthorne | 123/179 B |
| 3,514,621 | 5/1970 | Farmer et al. | 290/37 |
| 3,685,606 | 8/1972 | Blow, Jr. | 290/38 C |
| 3,704,702 | 12/1972 | Aono | 123/179 G |
| 3,712,283 | 1/1973 | Kiess et al. | 123/179 A |
| 3,923,031 | 12/1975 | Keranen | 123/179 L |
| 3,964,457 | 6/1976 | Coscia | 123/339 |
| 3,982,519 | 9/1976 | Moon | 123/179 L |
| 4,100,892 | 7/1978 | Asano | 123/179 G |
| 4,114,570 | 9/1978 | Marchak et al. | 123/179 G |
| 4,131,304 | 12/1978 | Wagner | 123/179 B |
| 4,148,282 | 4/1979 | Grassle et al. | 123/179 G |
| 4,196,466 | 4/1980 | Noddings et al. | 123/352 |
| 4,208,991 | 6/1980 | Reddy | 123/179 G |
| 4,224,913 | 9/1980 | Barnard | 123/440 |
| 4,231,333 | 11/1980 | Thatcher et al. | 123/440 |
| 4,236,594 | 12/1980 | Ramsperger | 290/DIG. 3 |
| 4,250,849 | 2/1981 | Takase | 123/179 G |
| 4,250,858 | 2/1981 | Jeenicke et al. | 123/480 |
| 4,257,377 | 3/1981 | Kinugawa et al. | 123/492 |
| 4,266,275 | 5/1981 | Marchak | 364/431 |
| 4,266,521 | 5/1981 | Nakano et al. | 123/491 |
| 4,267,810 | 5/1981 | Wesemeyer et al. | 123/416 |
| 4,345,554 | 8/1982 | Hildreth et al. | 123/179 BG |
| 4,392,059 | 7/1983 | Nespor | 123/179 BG |

*Primary Examiner*—Andrew M. Dolinar

*Attorney, Agent, or Firm*—Andrus, Sceales, Starke & Sawall

[57] ABSTRACT

A two cycle internal combustion engine (21) is remotely started and operated by a control (23) including a programmable microprocessor (42) selectively operable by a remote start command station (25) operating through an interconnected cable or telecommunications and a local start command station (24). Engine speed and temperature are sensed to modify the fuel and/or the air/fuel ratio supplied to the engine (21) to efficiently start and run the engine (21) under severe adverse climatic conditions and to reinitiate cranking when engine speed fails to reach predetermined levels following predetermined cranking periods. When running, a load (36) is automatically connected and disconnected in response to the sensed operating conditions of the engine (21) while modifications are selectively made to the fuel and air/fuel ratio and/or cranking reinitiation is applied according to sensed operating parameters.

11 Claims, 14 Drawing Figures

Microfiche Appendix Included
(1 Microfiche, 19 Pages)

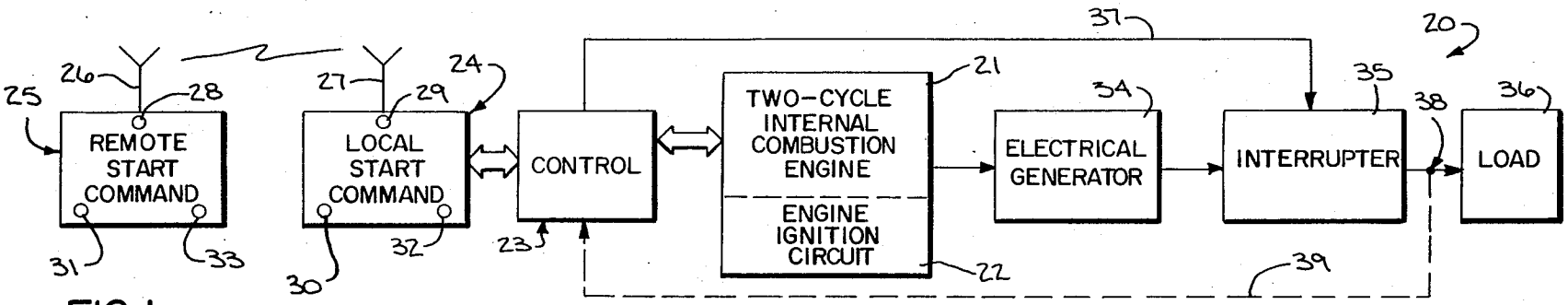
FIG. 1
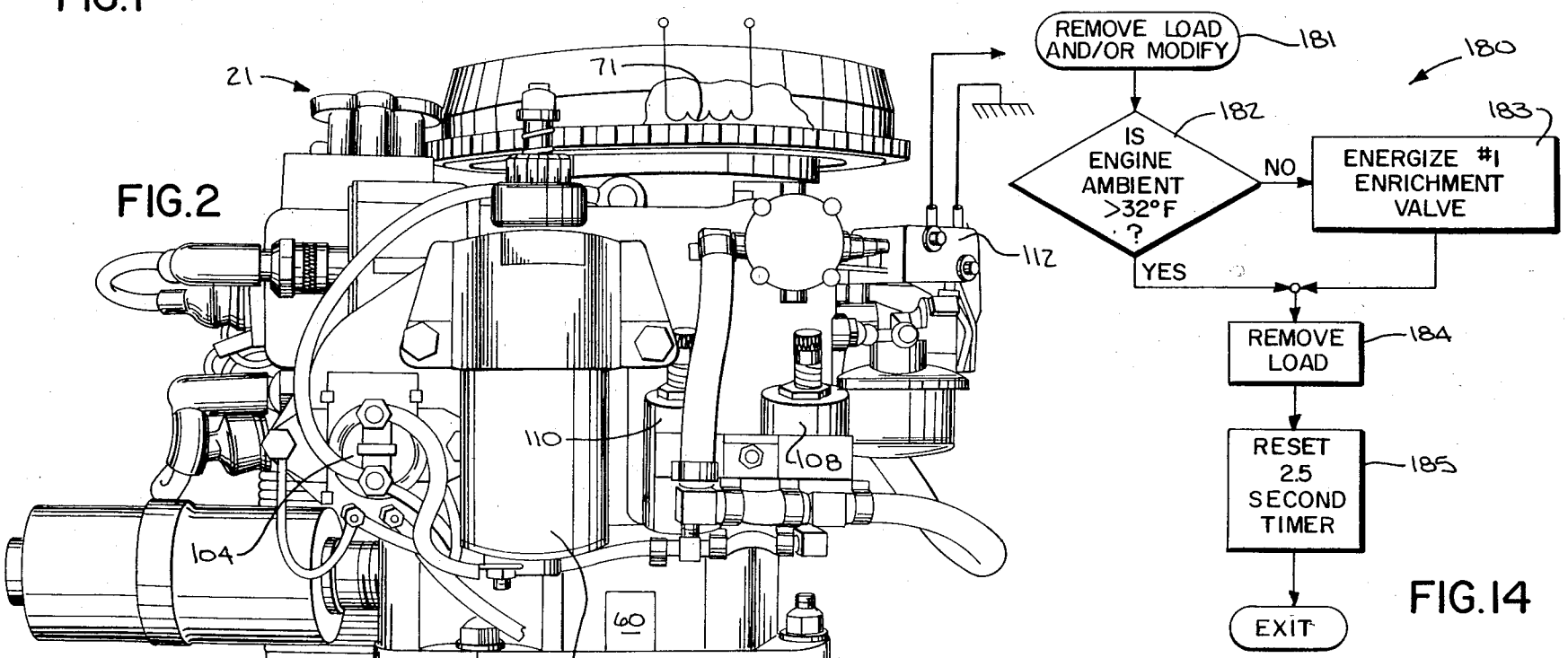
FIG. 2
FIG. 14

FIG. 4
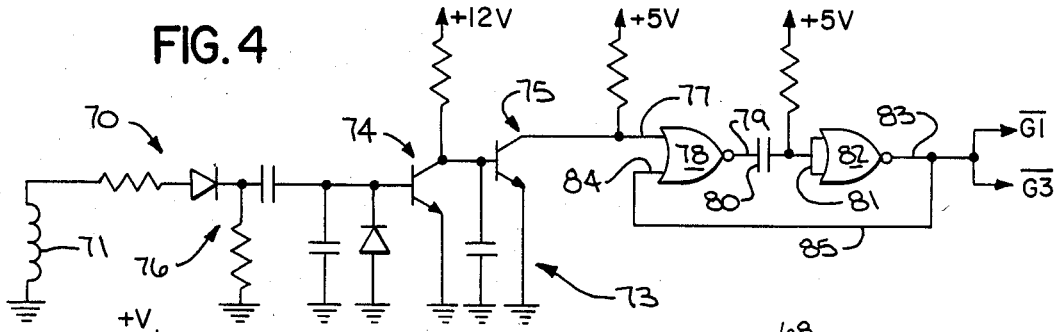
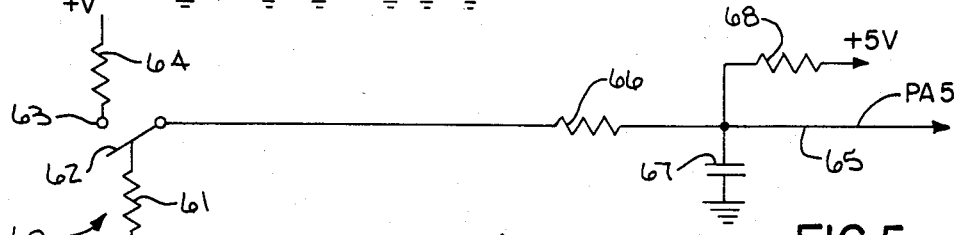
FIG. 5
FIG. 6
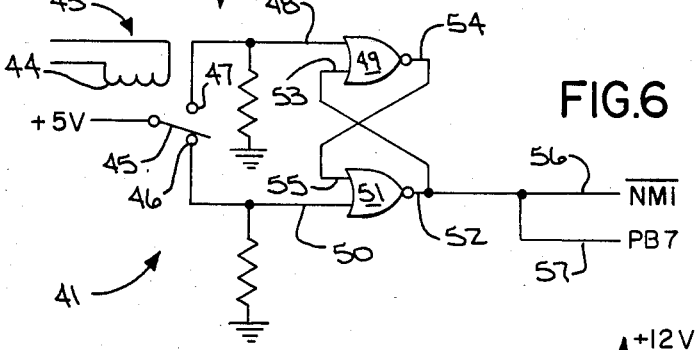
FIG. 7
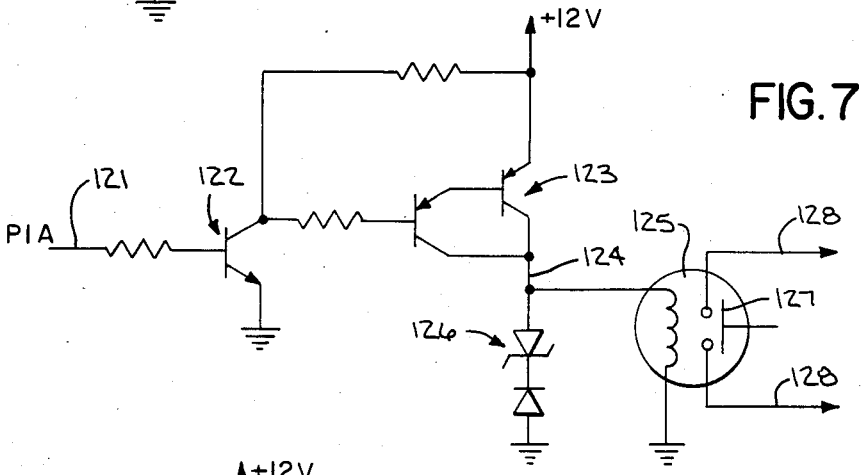
FIG. 8
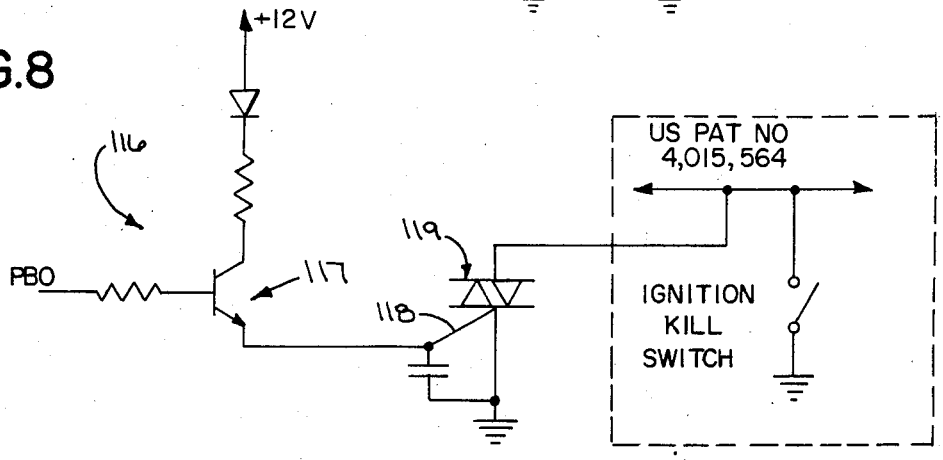

REMOTE STARTER FOR INTERNAL COMBUSTION ENGINE

REFERENCE TO MICROFICHE APPENDIX

A microfiche Appendix containing one (1) microfiche and a total of nineteen (19) frames is incorporated herein.

TECHNICAL FIELD

This invention relates to a remote starter for an internal combustion engine.

BACKGROUND ART

Various systems have been devised to start and run internal combustion engines in response to a start command supplied immediately adjacent to such engine. Where such engines are to be operated in severe climatic environments, it is frequently inconvenient and many times uncomfortable for an operator to be physically present immediately adjacent to the engine to initiate a starting sequence, such as where the engine is to be used in the artic under frigid conditions or in the tropics under hot and humid conditions. The starting and running of such engines can encounter difficulties because of severe temperature extremes frequently resulting in the failure of an engine to start and/or run.

DISCLOSURE OF INVENTION

A control to remotely start an internal combustion engine includes a remotely located start command which is operable to provide a start command signal. A local start command is electrically connected to the remote command to provide a start initiation signal in response to the start command signal. A programmable microprocessor is electrically connected to the local start command and to the engine to initiate a starting sequence for the engine in response to the remote start command signal.

First and second fuel enrichment mechanisms and a throttle are selectively controlled in response to sensed engine speed and/or temperature to optimize the starting and/or running performance of the engine. The starter, the fuel enrichment mechanisms and the throttle are de-activated and another starting sequence is reinitiated in response to the failure of the engine to attain one of a plurality of predetermined speeds after cranking for a predetermined period of time. Cranking reinitiation and/or system modification for a selected number of times results in the disablement of the starting sequence and the activation of a warning light both locally and at the remote start command. The starting sequence is de-activated in response to the motor attaining one of the plurality of predetermined speeds while the throttle and the fuel enrichment mechanism is selectively controlled without the load applied for optimal operation of the engine. Upon sensing a predetermined speed, the load is connected to the engine and the throttle and possibly the fuel enrichment mechanism is selectively modified for optimal operation under sensed operating speed. A decrease in speed of the engine results in the load being disconnected followed by either a modification of the throttle in response to sensed operating speed and/or a modification of the fuel enrichment mechanism in response to sensed temperature and/or a cranking reinitiation to initiate another starting sequence.

BRIEF DESCRIPTION OF THE DRAWINGS

FIG. 1 is a block diagrammatic view of a remotely controlled internal combustion engine selectively coupled to energize a load;

FIG. 2 is an illustration of the internal combustion engine of FIG. 1;

FIGS. 4 through 8 are electrical circuit schematics showing a portion of the control of FIG. 1; and FIGS. 9 through 14 are diagrams illustrative of the operation of the control of FIG. 1.

BEST MODES FOR CARRYING OUT THE INVENTION

Figure 3:
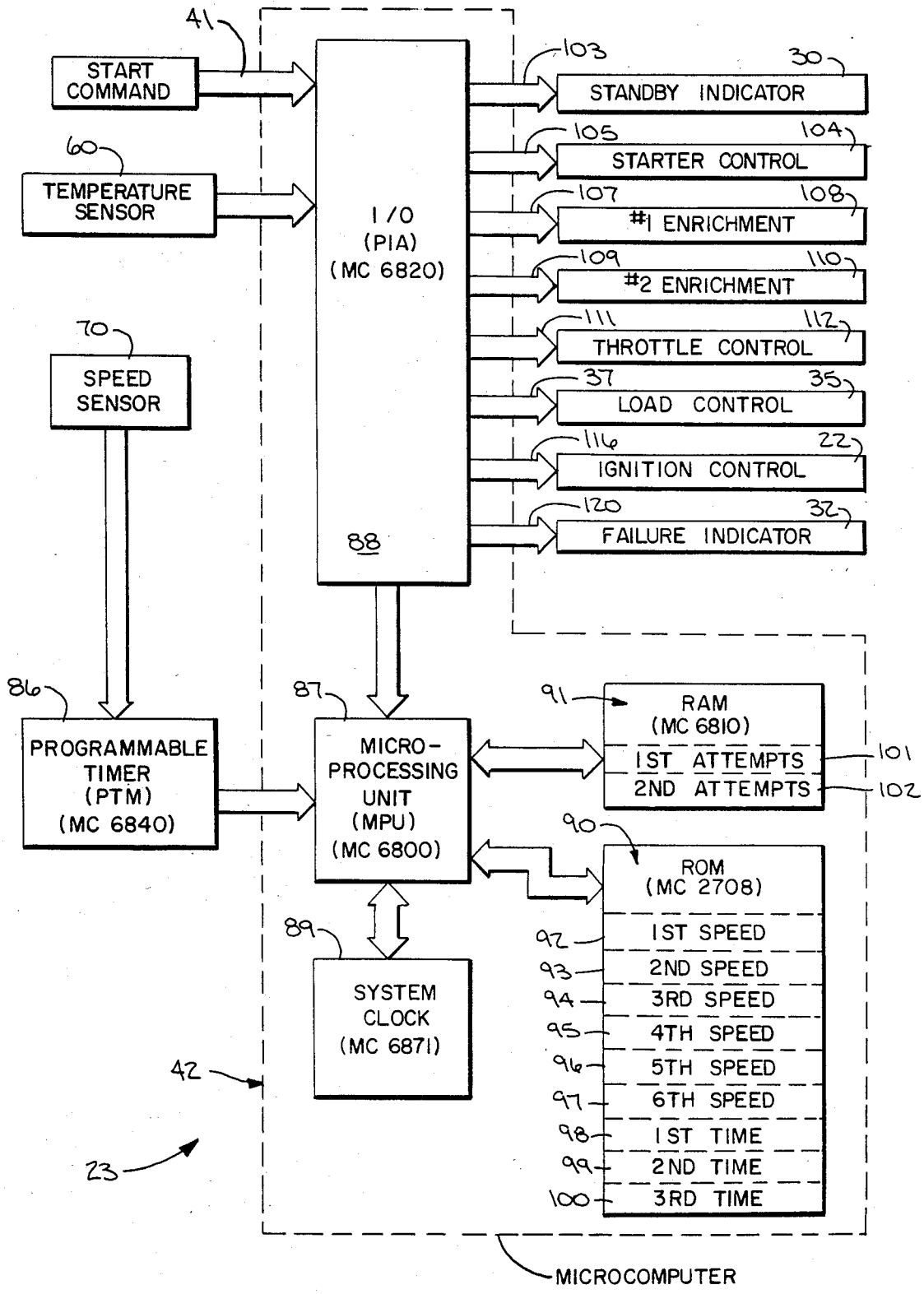
FIG. 3 is a block diagrammatic illustration of a portion of the control and including a digital computer for controlling the starting and running of the engine of FIGS. 1 and 2.

A remotely controlled energy system 20 may include a two cycle internal combustion engine 21, which may be of conventional construction, and energized by an engine ignition circuit 22. One type of a desirable ignition circuit is shown in the U.S. Pat. No. 4,015,564 which issued on Apr. 4, 1977 to Arthur O. Fritzner.

The engine 21 is selectively started and operated by a control 23 in response to the operation of a local start command 24. A remote start command 25 may be positioned miles away from the local start command 24 and yet provide command control to the internal combustion engine 21 through the control 23 and the local start command 24, such as through inter-connected cable or telecommunications. The remote start command 25 is illustrated as a radio transceiver having an antenna 26 which communicates with an antenna 27 associated with the local start command radio transceiver 24 so that both start command units 24 and 25 send and receive command signals.

To start the engine 21, a remotely located operator may selectively operate a start button 28 to produce a corresponding command signal via antenna 26 which is received by antenna 27 of start command 24 to provide a command input to control 23 which, in turn, initiates a starting sequence for the engine 21. Alternatively, a local operator may selectively operate a start button 29 of start command 24 to provide a command input to control 23 which, in turn, initiates a starting sequence for the engine 21.

The control 23 provides a signal to the local start command 24 to energize a standby signal or light 30 while a standby signal or light 31 of start command 25 is simultaneously energized to indicate that the system is ready to initiate a starting sequence. The control 23 also provides a signal to the start command 24 to energize a failure signal or light 32 while a failure signal or light 33 of start command 25 is simultaneously energized to indicate that a number of unsuccessful attempts have been undertaken to start the internal combustion engine 21.

The engine 21 provides a mechanical output to operate an electrical generator 34 which, in turn, is connected through an interrupter switch 35 to selectively energize a load 36. The control 23 selectively controls the interruptor 35 via a control circuit 37 to selectively electrically connect and disconnect the load 36 from the electrical generator 34. Under an alternative mode of operation, the electrical energy supplied from the generator 34 to the load 36 may be monitored as at 38 and supplied through a connecting circuit 39 to the control 23.

A start command interface 41 (FIG. 6) inter-connects a microcomputer 42 (FIG. 3) with the local start command 24 and includes an interconnecting circuit 43. The operation of either the remote start button 28 or the local start button 29 energizes a coil 44 which operates to transfer a switch arm 45 from a switch contact 46 to a switch contact 47. The switch contact 47, in turn, is connected to an input 48 of a NOR logic circuit 49 while the switch contact 46 is connected to an input 50 of a NOR circuit 51. An output 52 of NOR 51 is connected to an input 53 of NOR 49. In turn, an output 54 of NOR 49 is connected to an input 55 of NOR 51. The output 52 of NOR 51 is also connected to an $\overline{NMI}$ input 56 and a PB7 input 57 of the microcomputer 42. The operation of either of the start command buttons 28 or 29 will energize the coil 44 to transfer the switch arm 45 from contact 46 to engage contact 47. In such manner, an input signal is applied to input 48 of NOR 49 to transfer states of NORs 49 and 51, which operate as a bi-stable flip flop, to provide a start command signal to inputs 56 and 57 of the microcomputer 42 to command a starting sequence.

A temperature sensor 60 is mounted at or near the internal combustion engine 21 to sense the ambient temperature at such location. The temperature sensor 60 operates as a temperature responsive switch to provide a first output signal when the temperature is at or below a predetermined temperature and a second output signal when the temperature is above such predetermined temperature. The temperature sensor 60 may be selected and/or adjusted to transfer states in response to any one of a number of predetermined temperatures, such as 32° Fahrenheit, 0° Fahrenheit, or any other preselected temperature. In the illustration of FIG. 5, the temperature sensing element 61 is symbolically shown to operate a switch arm 62 to selectively engage a terminal 63 connected through a resistor 64 to a constant voltage source. In any event, the temperature sensor 60 is coupled to a PA5 input 65 of the microcomputer 42 through a serially connected resistor 66 which is connected to the system ground through a stabilizing capacitor 67 and connected to a constant potential voltage source through a resistor 68.

A speed sensor 70 may consist of any well-known mechanical or electrical speed sensing device, such as a sensing coil 71 (FIG. 4) mounted adjacent to a flywheel 72 containing one or more magnets (not shown) to produce a series of pulses within coil 71 having a frequency corresponding to the engine speed. One desirable speed sensor is shown in U.S. Pat. No. 4,093,906 issued on June 6, 1978 to James Richard Draxler, and assigned to a common assignee herewith. The pulse generated by coil 71 is supplied to an amplifier 73 including a pair of interconnected NPN type transistors 74 and 75 and a noise filtering, level shifting, waveform adjusting circuit 76. The output of the amplifier stage 73 is supplied to an input 77 of a NOR circuit 78. An output 79 of NOR 78 is connected through a capacitor 80 to a pair of joined inputs 81 of a NOR circuit 82. An output 83 of NOR 82 is connected to an input 84 of NOR 78 through a feedback circuit 85. The NOR circuits 78 and 82 are inter-connected to operate as a one-shot multi-vibrator which responds to an input pulse supplied by coil 71 via the circuit 76 and amplifier 73 to provide a corresponding pulse to the inputs $\overline{G1}$ and $\overline{G3}$ of a programmable timer 86.

The programmable timer (PTM) 86 may be selected from any one of a number of digital timers, such as marketed commercially by the Motorola Corporation under the designation MC/6840. The timer 86 is connected in a conventional manner to a micro-processing unit (MPU) 87 of microcomputer 42, which may be selected from any one of a number of known micro-processing units, such as marketed by the Motorola Corporation under the designation MC/6800.

The micro-processing unit 87 communicates with an input-output unit (I/O) 88 which may be selected from any one of a number of commercial units, such as marketed by the Motorola Corporation under the designation MC/6820. The micro-processing unit 87 also communicates with a system clock 89 which may be selected from any one of a number of commercial units, such as marketed by the Motorola Corporation under the designation MC/6871. One or more read-only-memories (ROM) 90 (commercially available by the Motorola Corporation under the designation MC/2708) and one or more random-access-memories (RAM) 91 (marketed by the Motorola Corporation under the designation MC/6810) communicate with the micro-processing unit 87 in a well known manner. As used herein, the microcomputer 42 includes the micro-processing unit 87, the I/O 88, the clock 89, the ROM 90 and the RAM 91, which are interconnected in a well known manner.

The ROM 90 includes a plurality of memory locations which store a series of predetermined signals used in operating the system 20. For example, the memory locations designated as 92, 93, 94, 95, 96 and 97 store predetermined first, second, third, fourth, fifth and sixth speed signals respectively. The memory locations 98, 99 and 100 store predetermined first, second and third time signals respectively. The RAM 91 also provides a plurality of memory locations which store a series of predetermined signals used in operating the system 20. For example, the memory locations 101 and 102 store predetermined first and second attempts signals respectively. If desired, additional memory locations can be provided to store other information, such as revolutions per minute for example.

The microcomputer 42 selectively provides a standby signal at a PB1 output which is operatively connected to the standby indicator 30 through a connecting circuit 103 to indicate that the engine 21 is in condition to initiate a starting sequence.

The microcomputer 42 responds, under certain conditions, to a start command such as provided by the operation of one of the buttons 28 or 29 to operatively provide a starting signal at a PA1 output to a starter solenoid 104 through an interface circuit 105 to initiate a starting sequence for an interconnected starter 106. The microcomputer 42 provides a first enrichment signal at a PA2 output which is operatively connected through an interface circuit 107 to selectively transfer a #1 enrichment solenoid operated valve 108 between a first enrichment condition and a second enrichment condition. The microcomputer 42 provides a second enrichment signal at a PA3 output which is operatively connected through an interface circuit 109 to selectively transfer a solenoid operated #2 enrichment valve 110 to provide a third enrichment condition in conjunction with the simultaneous operation of the #1 enrichment valve 108. The enrichment valves 108 and 110 are connected within the fuel supply to selectively control the amount of fuel, such as gasoline or the like, to the carburetor of the engine 21. The microcomputer 42 provides a throttle signal at a PA0 output which is operatively connected through an interface circuit 111 to selectively transfer a solenoid operated throttle 112 between first and second air-fuel ratios. Alternatively, a stepper motor may be used in lieu of the throttle solenoid 112. In any event, the air-fuel ratio is selectively adjusted by the throttle control in accordance with the command provided by the microcomputer 42.

The microcomputer 42 provides a load signal at a PA4 output which is operatively connected through the interface circuit 37 to selectively transfer the relay controlled interrupter 35 between an opened and closed conditions. The microcomputer 42 provides a disable control signal at a PBO output which is operatively connected through an interface circuit 116 to the engine ignition circuit 22 to selectively disable the ignition by grounding the ignition capacitor within a capacitive discharge system, such as shown in the Fitzner U.S. Pat. No. 4,015,564. With reference to FIG. 8, an NPN type transistor 117 interconnects a gate circuit 118 of a triac 119 to the PBO terminal of the microcomputer 42. When receiving an ignition kill command from the microcomputer 42, the transistor 117 turns on to gate the triac 119 into conduction to thereby short circuit the ignition primary coil in the ignition circuit 22 to completely disable the internal combustion engine 21. The failure indicator 32 within the start command 24 is connected to the PA7 output of the microcomputer 42 through a connecting circuit 120.

The interface circuits 105, 107, 109, 111 and 37 may each be constructed as shown in FIG. 7. The interface circuit includes an input circuit 121 which is connected to a respective output terminal (i.e. PA0–PA4) of the microcomputer 42. A NPN type transistor 122 receives a command signal from the microcomputer 42 to operate a Darlington pair transistor circuit 123 having a collector output 124 connected to an output relay 125. The output 124 is also clamped to the system neutral through a Zener diode circuit 126. The relay 125 closes a switch contact 127 to complete a circuit through output leads 128 to energize an appropriate solenoid or relay in response to the output signal supplied by the microcomputer 42. In such manner, the microcomputer 42 provides a very small output signal to operatively energize one or more selected solenoids or relay coils to energize the starter, one or both of the enrichment valves, the throttle and/or the load switch.

Figure 9:
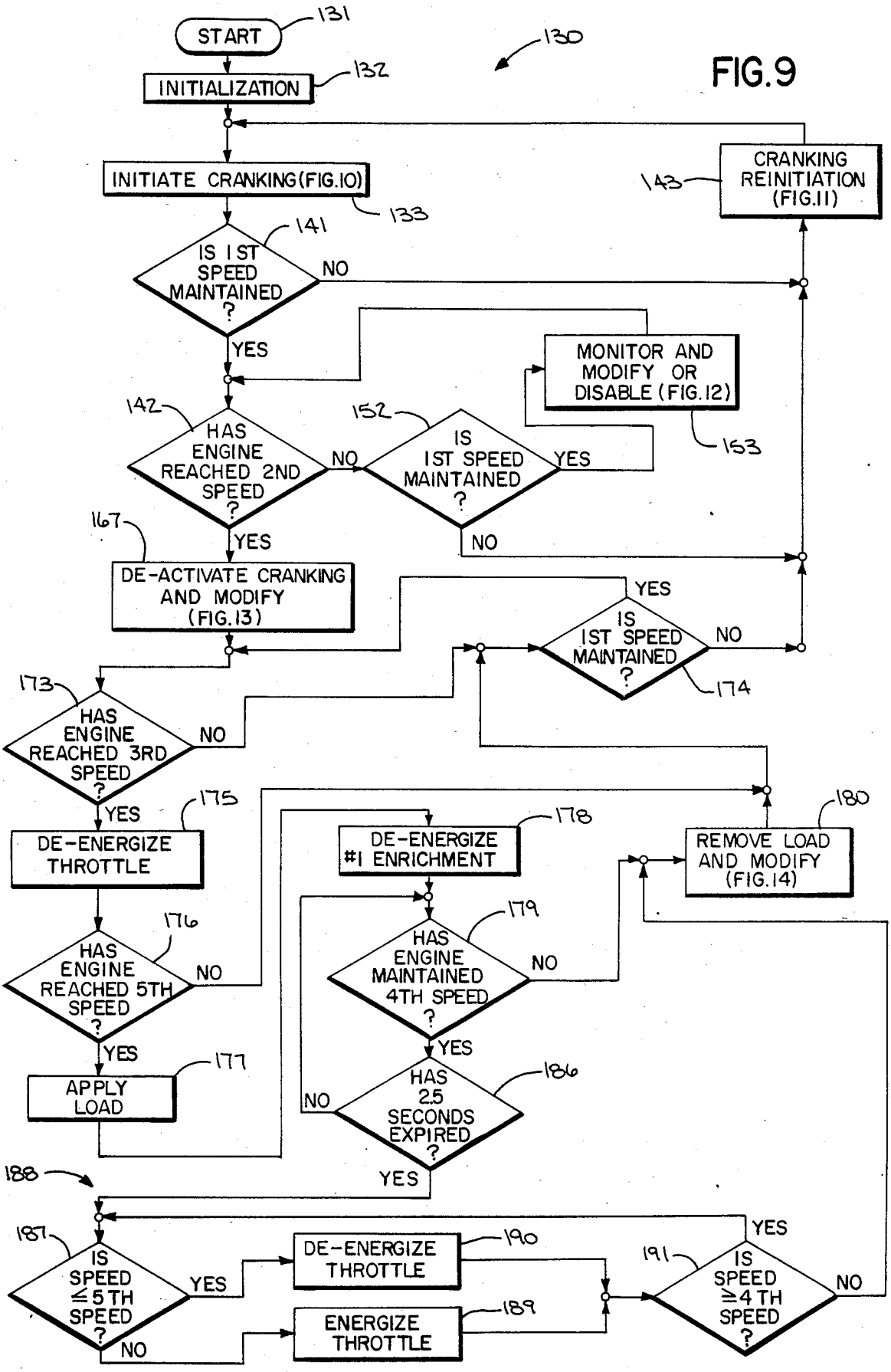

A major loop portion 130 of the microcomputer program is illustrated in FIG. 9. The program begins at point 131 when the start command 41 responds to the operation of the remote start button 28 or the local start button 29 to supply a start command signal at the NMI input 56 and the PB7 input 57. The program thereafter proceeds to a step 132 where the computer provides for the initialization of the system. For example, the initial values for the system are entered into designated locations in the RAM 91 and various counters such as the elapsed time counters, the number of attempts counters, etc. are reset. After the initialization step 132, the program proceeds to routine 133 which is further detailed in FIG. 10 where a cranking initiation attempt is provided for.

Figure 10:
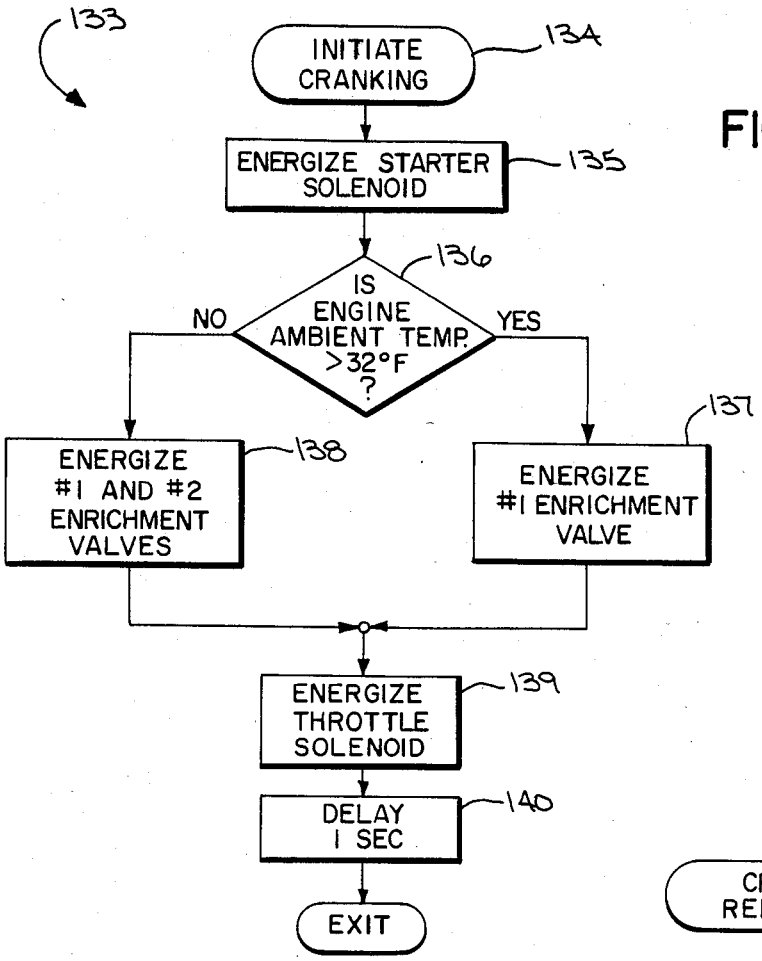

With reference to FIG. 10, the program enters the cranking initiation step 133 at step 134 and proceeds to step 135 to provide the starting signal to the interface circuit 105 to energize the starter solenoid 104 and provide an engine cranking operation by the starter 106.

The program proceeds to a decision point 136 where it is determined whether the ambient temperature condition at sensor 60 is above a predetermined temperature, such as 32° Farenheit for example. If the sensed ambient temperature is above the predetermined temperature, the program proceeds to step 137 to provide the first enrichment signal to the interface circuit 107 to operatively energize the #1 enrichment valve 108 and provide the second predetermined fuel enrichment to the engine 21. If the sensed ambient temperature at step 136 is at or below the predetermined temperature, the program proceeds to step 138 to provide the first and second enrichment signals to circuits 107 and 109, respectively, to operatively energize the #1 enrichment valve 108 and the #2 enrichment valve 110 to provide the third predetermined fuel enrichment to the engine 21. Thus if the ambient temperature sensed at the engine is above the predetermined temperature, the engine 21 will receive a second predetermined fuel enrichment which is less than the third predetermined fuel enrichment it would receive if the sensed ambient temperature is at or below the predetermined temperature.

Following steps 137 or 138, the program continues with step 139 to provide the throttle signal to the interface circuit 111 to operatively energize the throttle solenoid 112 to transfer the engine operation from a first predetermined air-fuel ratio to a second predetermined air-fuel ratio. Following the throttle operating step 139, the program continues with step 140 to provide a system operating delay of a first predetermined duration, such as one (1) second for example, as provided by the memory location 98 of ROM 90. Such delay provides a predetermined time for the starter to enable engine operation.

Figure 11:
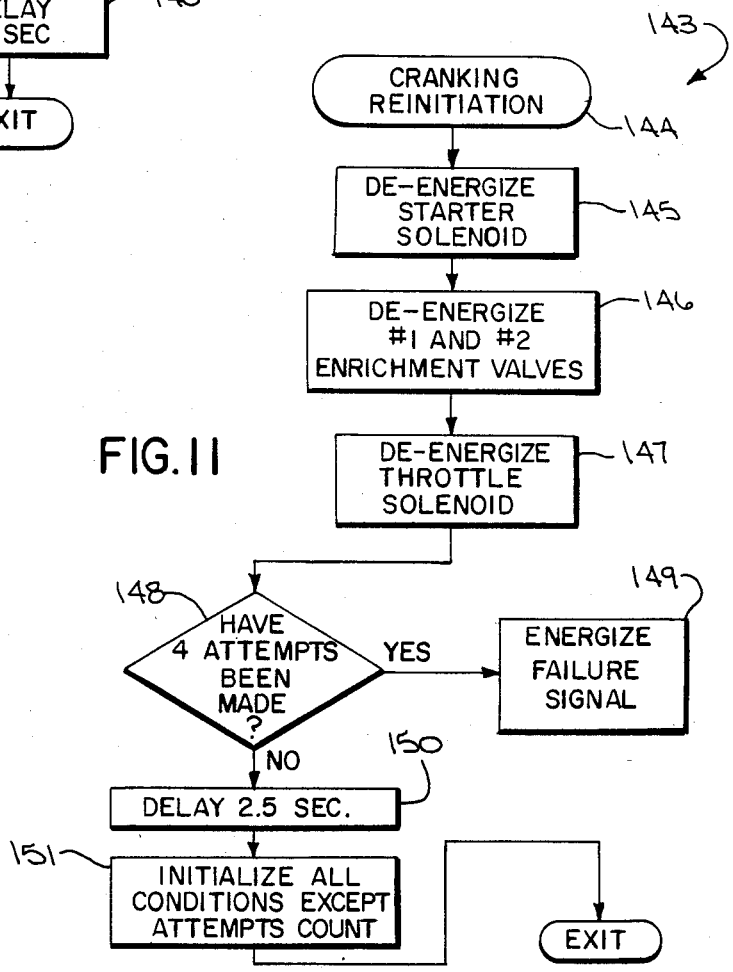

Following the time delay step 140, the program exits the cranking initiation routine 133 and continues to a decision point 141 where the operating speed condition of engine 21 is determined. If the engine 21 maintains a first predetermined speed, such as an engine cranking speed of 500 RPM for example, as provided at the memory location 92 of the ROM 90, the program will continue to an engine speed decision point 142. If the engine 21 is not maintaining the first predetermined speed, the program continues to a cranking reinitiation routine 143, where it enters at step 144 as illustrated in FIG. 11. The program proceeds to step 145 where the microcomputer 42 provides a signal to the interface circuit 105 to de-energize the starter solenoid 104 and stop the operation of starter 106. The program proceeds to step 146 where the microcomputer 42 provides signals to the interface circuits 107 and 109 to de-energize the #1 enrichment valve 108 and the #2 enrichment valve 110 to provide the first fuel enrichment condition. The program thereafter proceeds to step 147 where the microcomputer 42 provides a signal to the interface circuit 111 to de-energize the throttle solenoid 112 and provide the first predetermined air-fuel ratio.

Following step 147, the program proceeds to a decision point 148 where it is determined how many starting attempts of engine 21 have been made by the control 23. If four starting attempts have been made by the cranking initiation routine 133, as determined by the second attempts memory location 102 of the RAM 91, the program continues to step 149 where the microcomputer 42 supplies a failure signal to the failure indicator 32 through the connecting circuit 120 to provide a warning to indicate a system failure. Such warning will be provided by both the local light 32 and the remote light 33. When proceeding to step 149, the program becomes dormant and the cranking initiation routine 133 is deactivated until the control 23 commands another start sequence, such as through the operation of the local start button 29 or the remote start button 28.

If three or less starting attempts have been carried out by the cranking initiation routine 133, as determined by the second attempts memory location 102 of the RAM 91, the program proceeds to a delay step 150 where the program operating sequence is delayed for a second predetermined time interval, such as provided by the memory location 99 of the ROM 90, such as 2.5 seconds for example. Following the time delay of step 150, the program proceeds to step 151 where all conditions of the program are initialized, such as all timing counters, the number of attempts counters, etc., except for the attempts count corresponding to the decision point 148. The program exists the initialization step 151 of the cranking reinitiation routine 143 and recycles to the cranking initiation routine 133, which was previously discussed with respect to FIG. 10. In such manner, the cranking initiation routine 133 and the cranking reinitiation routine 143 are connected in a closed loop wherein the cranking initiation routine 133 may be repeated for a predetermined number of times as determined by the memory location 102 of the RAM 91. If the engine 21 is unable to maintain the first predetermined speed provided by memory location 92 of ROM 90 and a predetermined number of cranking initiation attempts as provided by memory location 102 of the RAM 91 have occurred, the program will enter step 149 to energize the failure lights 32 and 33 to indicate a failure condition for the system 20.

If the program at decision point 141 determines that engine 21 is maintaining a first predetermined speed, such as a cranking speed of 500 RPM for example, the program will proceed to the decision point 142 to determine whether the engine 21 has reached a second predetermined speed as provided by the memory location 93 of the ROM 90, such as 2000 RPM for example. If the engine 21 has not reached the second predetermined speed at decision point 142, the program proceeds to a decision point 152 where it is determined whether the engine 21 is maintaining the first predetermined speed, as provided by memory location 92 in the ROM 90. If the first predetermined speed is not maintained as determined at the decision point 152, the program proceeds to the cranking reinitiation step 143 as previously described with respect to FIG. 11.

Figure 12:
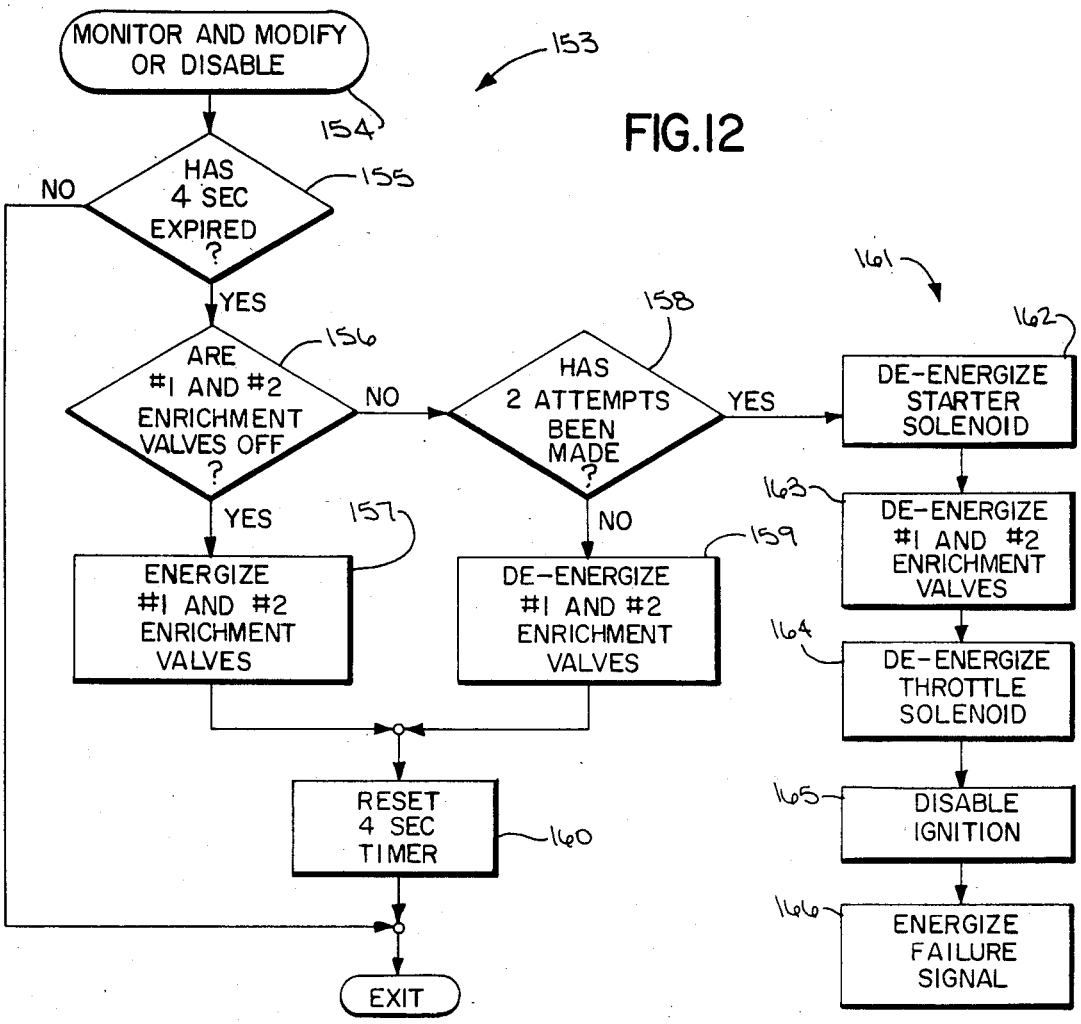

If the engine 21 is maintaining the first predetermined speed as determined by decision point 152, the program proceeds to a monitoring and modifying or disabling routine 153, which enters at step 154 in FIG. 12. The program proceeds to a decision point 155 which determines whether a third predetermined time, as provided at the memory location 100 of the ROM 90, such as four seconds for example, has expired from the start of the monitor and modify routine 153. IF the third predetermined time period has not expired, the program proceeds from decision point 155 to exit the monitoring and modifying or disabling routine 153 to re-enter the decisional point 142. If the third predetermined time period has expired as determined at decision point 155, the program proceeds to a decision point 156 where it is determined whether the #1 enrichment valve 108 and the #2 enrichment valve 110 are de-energized. If the valves 108 and 110 are in a de-energized condition, the program proceeds to step 157 where the microcomputer 42 provides first and second enrichment signals to energize the #1 enrichment valve 108 and the #2 enrichment valve 110, respectively, to provide the third enrichment condition to the engine 21.

If the #1 enrichment valve 108 and the #2 enrichment valve 110 are not both de-energized, the program proceeds from decision point 156 to a decision point 158 where it is determined whether a first predetermined number of fuel varying attempts, as provided by the memory location 101 of RAM 91, have been provided by the monitor and modify routine 153. For example, if a first predetermined number of attempts, such as two for example, have not been made, the program proceeds to step 159 where the microcomputer 42 provides a signal to interface circuits 107 and 109 to de-energize the valves 108 and 110. Following steps 157 or 159, the program proceeds to a timer resetting step 160 where the counter corresponding to the third predetermined time memory location 100 of ROM 90 is reset before the program exits from the monitoring and modifying or disabling routine 153 to proceed to the decision point 142.

If a first predetermined number of attempts by the monitor and modify routine 153 have been made, as determined by the decision point 158, the program proceeds to a disable sequence 161 and particularly to step 162 where the microcomputer 42 provides a signal to interface circuit 105 to de-energize the starter solenoid 104 and starter 106. The program thereafter proceeds to step 163 where the microcomputer 42 provides signals to the interface circuits 107 and 109 to de-energize the #1 enrichment valve 108 and the #2 enrichment valve 110. Thereafter, the program proceeds to step 164 where the microcomputer 42 provides a signal to the interface circuit 111 to de-energize the throttle solenoid 112. Thereafter, the program proceeds to an ignition disable step 165 where the microcomputer 42 provides a signal to the interface circuit 116 to disable the operation of the engine ignition circuit 22. Thereafter, the program proceeds to step 166 where the microcomputer 42 provides a signal through the circuit 120 to energize the failure indicators 32 and 33. The program operation into and through the disable sequence 161 including the steps 162 through 166, inclusive, effectively disables the internal combustion engine 21 by operatively short circuiting the engine ignition circuit 22 to prevent any operation of the engine 21. Further, the starter solenoid 104, the enrichment valves 108 and 110 and the throttle solenoid 112 are de-energized which further disables the system.

The selective operation of the enrichment valves 108 and 110 at steps 157 and 159 permits the optimization of the starting sequence where the engine 21 has maintained a first predetermined speed (i.e. a cranking speed of 500 RPM for example) but has not yet reached a second predetermined speed (i.e. 2000 RPM for example) so that the engine may adjust its operation to enhance the chances of reaching the second predetermined speed. If the first predetermined speed has been maintained for a predetermined time (i.e. 4 sec. as as provided by the memory location 100 of ROM 90) as determined at decision point 155 and both of the enrichment valves 108 and 110 are energized and a predetermined number of attempts (i.e. 2 as provided by memory location 101 of RAM 91) have taken place and the system can only maintain the first predetermined speed (i.e. cranking speed of 500 RPM for example) but cannot reach the second predetermined speed (i.e. 2000

RPM), the program will enter the disable sequence 161 which effectively terminates all operations until the reasons for the failure can be rectified.

Figure 13:
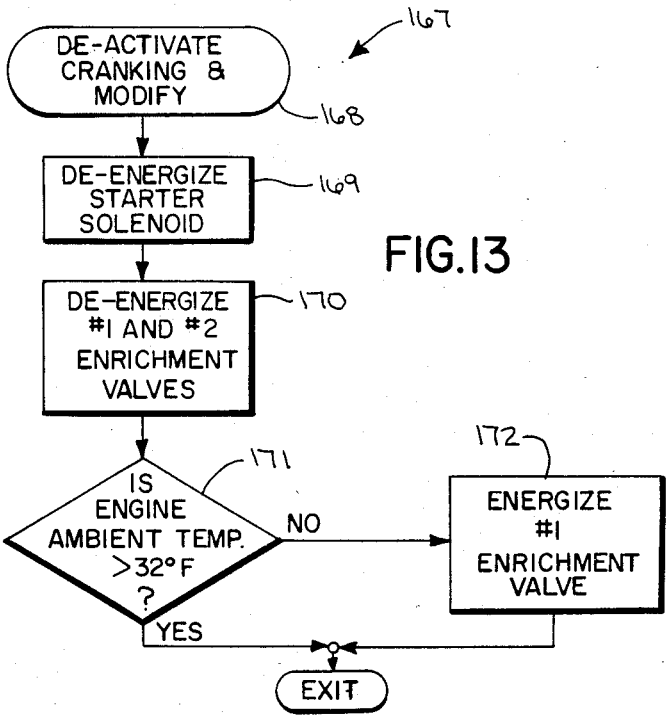

If the engine 21 reaches the second predetermined speed (i.e. 2000 RPM for example) as determined at the decision point 142, the program proceeds to the cranking de-activation and modifying routine 167, which enters at step 168 in FIG. 13. The program proceeds to the starter de-energization step 169 where the microcomputer 42 provides a signal to the interface circuit 105 to de-energize the starter solenoid 104 and starter 106 which effectively terminates the cranking sequence for engine 21. The program proceeds to step 170 where the microcomputer 42 provides signals to the interface circuits 107 and 109 to de-energize the #1 enrichment valve 108 and the #2 enrichment valve 110. The program proceeds to decision point 171 where it is determined whether the ambient temperature sensed by sensor 60 is above a predetermined temperature, such as 32° Farenheit for example. If the sensed temperature at sensor 60 is at or below the predetermined temperature, the program proceeds to a step 172 where the microcomputer 142 provides a signal to the interface circuit 107 to energize the #1 enrichment valve 108. If the sensed temperature at sensor 60 is above the predetermined temperature, the program exits from the decision point 171 to proceed to a decision point 173 where it is determined whether the engine 21 has reached a third predetermined speed (i.e. 3000 RPM for example). In the alternative sequence, the program leaves step 172 to enter the decision point 173.

If the engine 21 has not reached a third predetermined speed, namely the third speed (i.e. 3000 RPM) provided at memory location 94 of ROM 90, the program will leave the decision point 173 and proceed to a decision point 174 where it is determined whether the engine 21 has maintained the first predetermined speed, namely the first speed (i.e. 500 RPM) provided at memory location 92 of ROM 90. If the engine 21 has maintained the first speed, the program recycles to enter the decision point 173 to again determine whether the engine 21 has reached the third predetermined speed. If the engine has not maintained the first predetermined speed (i.e. cranking speed of 500 RPM) as determined by decision point 174, the program proceeds to the cranking reinitiation routine 143, which has been previously described with respect to FIG. 11.

If the engine has reached the third predetermined speed (i.e. 3000 RPM for example), the program leaves the decision point 173 and enters step 175 where the microcomputer 42 provides a signal to interface circuit 111 to de-energize the throttle solenoid 112. Thereafter, the program proceeds to decision point 176 where it is determined whether the engine 51 has reached a fifth predetermined speed, as provided by the fifth speed memory location 96 of the ROM 90 (i.e. 5000 RPM for example). If the engine 21 has not reached the fifth predetermined speed, the program leaves decision point 176 and enters the decision point 174 where it is determined whether the engine 21 has maintained the first predetermined speed (i.e. cranking speed of 500 RPM for example). Thus, if the engine 21 has failed to reach the fifth predetermined speed (i.e. 5000 RPM) but has maintained the first predetermined speed (i.e. cranking speed of 500 RPM for example), the program recycles to again enter the decision point 173. If the engine has failed to reach the fifth predetermined speed and fails to maintain the first predetermined speed, the program recycles to the cranking reinitiation routine 143, as above described with respect to FIG. 11.

If the engine 21 has reached the fifth predetermined speed (i.e. 5000 RPM for example) as determined by decisional point 176, the program proceeds to step 177 where the microcomputer 42 provides a signal to interface circuit 37 to operate the interrupter 35 to electrically connect the load 36 to the electrically generator 34. Thereafter, the program proceeds to step 178 where the microcomputer 42 provide a signal to the interface circuit 107 to de-energize the #1 enrichment valve 108. Thereafter, the program proceeds to a decision point 179 where it is determined whether the engine 21 has maintained a fourth predetermined speed (i.e. 4000 RPM for example), as provided by the fourth speed memory location 95 of ROM 90.

If it is determined that the engine 21 has not maintained the fourth predetermined speed after the load has been applied by step 177, the program leaves decision point 179 and enters the load removal and modifying routine 180 which is entered at step 181 in FIG. 14. The program proceeds to a decision point 182 where it is determined whether the ambient temperature of sensor 60 is above a predetermined temperature, such as 32° Farenheit for example. If the ambient temperature sensed at sensor 60 is at or below the predetermined temperature, the program proceeds to step 183 where the microcomputer 42 provides a signal to the interface circuit 107 to energize the #1 enrichment valve 108. If the ambient temperature sensed at sensor 60 is above the predetermined temperature, the program proceeds from decision point 182 directly to a step 184 where the microcomputer 42 provides a signal to interface circuit 37 to operate the interruptor 35 to disconnect the load 36 from the electrical generator 34. The program thereafter proceeds to a step 185 where the microcomputer 42 resets the counter corresponding to the second time provided by the memory location 99 of the ROM 90 before exiting the load removal and modifying routine 180 and proceeding to the decision point 174.

If the engine 21 has not maintained the fourth predetermined speed (i.e. 4000 RPM for example) as determined at decision point 179, the microcomputer 42 selectively regulates to the #1 enrichment valve 108 and removes the load 36 in the routine 180. In addition, if the engine 21 fails to maintain the first predetermined speed (i.e. cranking speed of 500 RPM for example), as determined at decision point 174, the program proceeds to the cranking reinitiation routine 143 which was previously described with respect to FIG. 11. If the engine 21 fails to maintain the fourth predetermined speed as determined by decision point 179 but has maintained the first predetermined speed as determined by decision point 174, the program recycles to decision point 173 to again determine whether the engine 21 is at or above the third predetermined speed as provided by the third speed memory location 94 of ROM 90.

If the engine 21 has maintained the fourth predetermined speed (i.e. 4000 RPM for example) as determined by decision point 179, the program proceeds to a decision point 186 where it is determined whether a second predetermined time has expired, as provided by the second time memory location 99 of ROM 90 (such as 2.5 seconds for example). If the engine has not maintained the fourth predetermined speed for the second predetermined period of time, the program recycles to the decision point 179. If, however, the engine 21 has maintained the fourth predetermined speed for the second predetermined time period, the program proceeds to decision point 187 which forms a part of the throttle position control program portion 188 where it is determined whether the speed of engine 21 is less than or equal to the fifth predetermined speed (i.e. 5000 RPM for example). If is determined that the speed of engine 21 is less than or equal to the fifth predetermined speed, the program proceeds to step 190 where the microcomputer 42 provides a signal to the interface circuit 111 to de-energize the throttle solenoid 112. If it is determined at decision point 187 that the speed of engine 21 is greater than the fifth predetermined speed, the program proceeds to step 189 where the microcomputer 42 provides a signal to the interface circuit 111 to energize the throttle solenoid 112. The program leaves steps 189 or 190 and enters a decision point 191 where it is determined whether the speed of engine 21 is greater than the fourth predetermined speed (i.e. 4000 RPM for example). If it is determined that the speed of engine 21 is greater than the fourth predetermined speed, as provided by the fourth speed memory location 95 of ROM 90, the program recycles to enter the decision point 187 to again determine whether the speed of engine 21 is less than or equal to the fifth predetermined speed (i.e. 5000 RPM). If it is determined at decision point 191 that the speed of engine 21 is not greater than the fourth predetermined speed (i.e. 4000 RPM for example), the program proceeds to the load removal and modifying routine 180 as described above with respect to FIG. 14. If the engine speed thus drops to or below the fourth predetermined speed (i.e. 4000 RPM for example), the program leaves the throttle position control program sequence 188 and enters the load removal and modifying routine 180.

Once the engine 21 has maintained the fourth predetermined speed (i.e. 4000 RPM for example) for a predetermined time (such as 2.5 seconds for example) provided by the second time memory location 99 of ROM 90, the program continues to operate and recycle within the throttle position control program sequence 188. Should the operating speed of engine 21 drop below the fourth predetermined speed, the program exits the throttle position control program sequence 188 and operatively removes the load as provided by the load removal and modifying routine 180. If the first predetermined speed (i.e. cranking speed of 500 RPM for example) is not maintained as determined at decision point 174, the program will leave the throttle position control program sequence 188, disconnect the load 36, and thereafter enter the cranking reinitiation routine 143 as previously discussed with respect to FIG. 11.

On the other hand, the program will leave the throttle position control program sequence 188 if the speed is at or below the fourth predetermined speed (i.e. 4000 RPM for example) as provided by decision point 191, remove the load as provided by routine 180, and recycle to decision point 173 if the engine 21 has maintained the first predetermined speed (i.e. cranking speed of 500 RPM for example). If the speed of engine 21 thereafter increases to reach the fifth predetermined speed as determined by decision point 176, the load 36 is reapplied at step 177 and the program re-enters the throttle position control program sequence 188 if the engine 21 can maintain the fourth predetermined speed for a predetermined period of time as provided by the second time memory location 99 of the ROM 90.

The operating system 20 provides a remote command and control to initiate a starting sequence for an internal combustion engine which is particularly desirable for use in operating environments having extreme temperature conditions. For example, the system might be expected to operate in artic conditions where the temperatures drop to or below 40° Farenheit or in tropic conditions where the temperatures might reach or exceed 100° Fahrenheit. In either event, the system 20 is capable of remotely initiating and controlling a cranking initiation sequence and a running sequence for the internal combustion engine.

The system 20 monitors a plurality of conditions at or near the engine 21 and selectively modifies one or more of a plurality of operating conditions at or near the engine 21 in a predetermined manner to provide optimum starting and running conditions to maximize the operation of the system 20. In the event the system 20 is unable to start or continue a running sequence in spite of having its operating systems varied or modified for optimum operation, the system will disable itself and provide local and remove failure signals to issue a warning that the system 20 is non-operational.

The remotely operated system 20 provides a starting and running sequence within a very short duration of time and automatically connects and disconnects the load 36 in response to sensed operating conditions of the engine 21. Furthermore, one or more enrichment valves and a throttle are selectively energized and de-energized in response to sensed operating conditions of the engine 21 to achieve optimal starting and running sequences for the engine 21.

The control system further monitors the operation of engine 21 to reinitiate a starting sequence where the engine 21 has either failed to operate or is marginally operating in a stalled type condition. The cranking control 23 also provides for a predetermined number of reinitiation attempts if the engine fails to immediately start. In the event of a predetermined number of failures in starting, the system automatically disables the system and provides local and remote warnings of such failure.

Reference is hereby made to the Microfiche appendix containing a program listing for the computer diclosed herein which forms a portion of this specification and includes one (1) microfiche and a total of nineteen (19) frames.

I claim:

1. A control to remotely start an internal combustion engine, comprising a remote start command remotely located with respect to said engine and operable to provide a start command signal, a local start command electrically connected to said remote command to provide a start initiation signal in response to said start command signal, means electrically connected to said local start command and to said engine to initiate a starting sequence for said engine in response to said remote start command signal, sensing means connected to sense a plurality of operating conditions of said engine during cranking, modifying means operatively connected to said sensing means to selectively modify at least one of a plurality of operating sequences for said engine in response to the failure of said engine to reach one of a plurality of predetermined operating conditions to optimize the starting performance of said engine, and cranking reinitiation means operatively connected to said sensing means to de-activate said starting sequence and initiate another starting sequence in response to the failure of said engine to reach one of said plurality of predetermined operating conditions.

2. A control to remotely start an internal combustion engine, comprising a remote start command remotely located with respect to said engine and operable to provide a start command signal, means electrically connected to said remote start command to initiate a starting sequence for said engine in response to said start command signal and including temperature means operatively connected to sense the temperature at said engine to energize a first fuel enrichment valve in response to engine temperature above a predetermined temperature and to energize said first enrichment valve and a second fuel enrichment valve in response to engine temperature at and below said predetermined temperature, and means operatively connected to said engine to sense the dual conditions of engine speed below a predetermined magnitude and engine cranking for a predetermined time to terminate said first starting sequence and reinitiate another starting sequence.

3. A control to remotely start an internal combustion engine, comprising a remote start command remotely located with respect to said engine and operable to provide a start command signal, means electrically connected to said remote start command to initiate a starting sequence for said engine in response to said start command signal, and means operatively connected to said engine to sense the dual conditions of engine speed below a predetermined magnitude and engine cranking for a predetermined time to terminate said first starting sequence and reinitiate another starting sequence, said reinitiation means includes means to deenergize a starter solenoid and first and second enrichment valves and a throttle solenoid in response to engine speed below a predetermined cranking speed and timer means to provide a delay of a second predetermined time before reinitiating another starting sequence.

4. A control to remotely start an internal combustion engine, comprising a remote start command remotely located with respect to said engine and operable to provide a start command signal, means electrically connected to said remote start command to initiate a starting sequence for said engine in response to said start command signal, and means operatively connected to said engine to sense engine speed above a first predetermined speed and below a second predetermined speed different than said first speed to vary the flow of fuel to said engine, said fuel varying means includes timing means and energizes first and second enrichment valves in response to the de-energization of said first and second enrichment valves and engine cranking for a predetermined time.

5. A control to remotely start an internal combustion engine, comprising a remote start command remotely located with respect to said engine and operable to provide a start command signal, means electrically connected to said remote start command to initiate a starting sequence for said engine in response to said start command signal, means operatively connected to said engine to sense engine speed above a first predetermined speed and below a second predetermined speed different than said first speed to vary the flow of fuel to said engine, and means to reinitiate said starting sequence in response to the failure of said engine to reach a predetermined speed, and wherein said fuel varying means includes counting means and timing means to de-energize first and second enrichment valves in response to the energization of said first and second enrichment valves and engine cranking for a predetermined time and fuel varying attempts below a predetermined number.

6. A control to remotely start an internal combustion engine, comprising a remote start command remotely located with respect to said engine and operable to provide a start command signal, means electrically connected to said remote start command to initiate a starting sequence for said engine in response to said start command signal, means operatively connected to said engine to sense engine speed above a first predetermined speed and below a second predetermined speed different than said first speed to vary the flow of fuel to said engine, means to reinitiate said starting sequence in response to the failure of said engine to reach a predetermined speed, counting means to count the number of fuel varying attempts, and means to disable said starting sequence means in response to a predetermined number of fuel varying attempts.

7. The control of claim 6, wherein said disable means includes means to operate an ignition disable switch to disable the engine ignition and operate a failure indicator and de-energize a starter solenoid and a throttle solenoid and first and second enrichment valves.

8. A control to remotely start an internal combustion engine having a starter and a fuel enrichment mechanism and a throttle, comprising a remote start command remotely located with respect to said engine and operable to provide a start command signal, starting means electrically connected to said remote start command to operate said starter and said throttle to initiate a starting sequence for said engine in response to said start command signal, means operatively connected to said engine to sense the operating speed of said engine, means operatively connected to said engine to time the cranking duration of said engine, start modifying means operatively connected to said speed sensing means and said timing means to selectively operate said fuel enrichment mechanism in response to the failure of said engine to reach a predetermined speed after cranking for a predetermined time to optimize the starting performance of said engine, cranking reinitiation means operatively connected to said speed sensing means and said timing means to de-activate said starter and said fuel enrichment mechanism and said throttle and to reactivate said starting means in response to the failure of said engine to attain one of a plurality of predetermined speeds after cranking for a predetermined period of time, disable means including counting means to terminate further starting sequences in response to a predetermined number of starting attempts, running means operatively connected to said speed sensing means to de-activate said starter and said fuel enrichment mechanism in response said engine attaining one of said plurality of predetermined speeds, first run modifying means operatively connected to said speed means to selectively operate said throttle in response to said engine attaining one of said plurality of predetermined speeds without a load applied, load means operatively connected to said speed sensing means to apply a load to said engine in response to said engine attaining one of said plurality of predetermined speeds, second run modifying means operatively connected to said speed means to selectively operate said throttle in response to the failure of said engine to operate above one of said plurality of predetermined speeds with said load applied, and load removal means operatively connected to said speed means to remove said load from said engine and to operate one of said first run modifying means and said cranking reinitiation means in response to said engine failing to maintain one of said plurality of predetermined speeds.

9. A control to remotely start an internal combustion engine having a starter and a throttle, comprising a remote start command remotely located with respect to said engine and operable to provide a start command signal, starting means electrically connected to said remove start command to operate said starter and said throttle to initiate a starting sequence for said engine in response to said start command signal, means operatively connected to said engine to sense the operating speed of said engine, means operatively connected to said sensing means to selectively connect a load to said engine in response to a sensed first predetermined speed, and means operatively connected to said sensing means to selectively disconnect said load in response to said engine operating below a second predetermined speed less than said first speed.

10. A control to remotely start an internal combustion engine having a starter, a fuel enrichment mechanism and a throttle, comprising a remote start command remotely located with respect to said engine and operable to provide a start command signal, starting means electrically connected to said remote start command to operate said starter and said throttle to initiate a starting sequence for said engine in response to said start command signal, means operatively connected to said engine to sense the operating speed of said engine, means operatively connected to said sensing means to selectively connect a load to said engine in response to a sensed first predetermined speed, and means connected to modify said fuel enrichment mechanism in response to the connection of said load to said engine.

11. A control to remotely start a two cycle internal combustion engine having a starter solenoid connected to selectively operate a starter and first and second solenoid operated enrichment valves each selectively operable between an open position and a substantially closed position to regulate the flow of fuel to said engine and a solenoid operated throttle selectively operable between a fully open position and a partially open position to vary the air/fuel ratio supplied to said engine, comprising a remote start command remotely located with respect to said engine and including a start initiation switch, a local start command locally located with respect to said engine and electrically connected to said remote start command to respond to the actuation of said start initiation switch to provide a start command, means electrically connected to said local start command to initiate cranking of said internal combustion engine by energizing said starter solenoid in response to said start command and including means operatively connected to a temperature sensor to energize said first fuel enrichment valve in response to engine temperature above a predetermined temperature and to energize said first enrichment valve and said second fuel enrichment valve in response to engine temperature at and below said predetermined temperature and means including first timing means operatively connected to energize said throttle solenoid for a first predetermined time, first cranking reinitiation means to reinitiate cranking of said internal combustion engine including means including first speed means operatively connected to an engine speed sensor to de-energize said starter solenoid and said first and second enrichment valves and said throttle solenoid in response to engine speed below a predetermined cranking speed and means including first counting means operatively connected to a failure indicator to provide a failure signal and deactivate said cranking initiation means in response to a first predetermined number of cranking intiation attempts and means including second timer means to operate said cranking initiation means in response to a delay of a second predetermined time and cranking attempts below said first predetermined number, means including first engine performance control means and means to disable said starter including second counting means and said first speed means and third timing means and second speed means operatively connected to said speed sensor to energize said first and second enrichment valves in response to the de-energization of said first and second enrichment valves and engine cranking for a third predetermined time and engine speed above said predetermined cranking speed and below a second predetermined speed and de-energize said first and second enrichment valves in response to the energization of said first and second enrichment valves and engine cranking for said third predetermined time and engine speed above said predetermined cranking speed and below said second predetermined speed and first engine performance control attempts below a second predetermined number of cranking initiation attempts and operate an ignition disable switch to disable the engine ignition and operate said failure indicator and de-energize said starter solenoid and said throttle solenoid and said first and second enrichment valves in response to the energization of said first and second enrichment valves and engine cranking for said third predetermined time and engine speed above said predetermined cranking speed and below said second predetermined speed and the occurrence of said second predetermined number of first engine performance control attempts, second cranking re-initiation means including said first and second speed means to operate said first cranking reinitiation means in response to engine speed below said cranking and said second predetermined speeds, second engine performance control means including said second speed means and said temperature means operating in response to said cranking initiation means and said first engine performance control means to de-energize said starter solenoid and said first and second enrichment valves in response to engine speed greater than said second predetermined speed and energize said first enrichment valve in response to engine temperature above said predetermined temperature, third cranking reinitiation means including said first speed means and third speed means operatively connected to said engine speed sensor to operate said first cranking reinitiation means in response to the operation of said second engine performance control means and engine speed below said third predetermined speed and said cranking speed, third engine performance control means including said third speed means to de-energize said throttle solenoid in response to the operation of said second engine performance control means and engine speed above a third predetermined magnitude, fourth cranking reinitiation means including said first speed means and fifth speed means operatively connected to said engine speed sensor to operate said first cranking reinitiation means in response to the operation of said third engine performance control means and engine speed below a fifth predetermined speed and said predetermined cranking speed, fourth engine performance control means including said fifth speed means to energize a load solenoid and apply a load to said engine and de-energize said first enrichment valve in response to engine speed above said fifth speed and the operation of said third engine performance control means, fifth engine performance control means including said second timer means and said fourth and fifth speed means to de-energize said throttle solenoid in response to running for said second predetermined time and the operation of said fourth engine performance control means and engine speed above said fourth and fifth predetermined speeds and energize said throttle solenoid in response to running for said second predetermined time and the operation of said fourth engine performance control means and engine speed less than said fifth predetermined speed and at and above said fourth predetermined speed, sixth engine performance control means including said temperature means and said fourth speed means and operating in response to the operation of one of said fourth and fifth engine performance control means and to engine speed at and below said fourth predetermined speed to energize said first enrichment valve and de-energize said load solenoid to remove said load and reset said second timing means in response to engine temperature at and below said predetermined temperature and de-energize said load solenoid to remove said load and reset said second timing means in response to engine temperature above said predetermined temperature, and fifth cranking reinitiation means including said first speed means to operate said first cranking reinitiation means in response to the operation of said sixth engine performance control means and engine speed below said predetermined cranking speed.

* * * * *